US008983090B2

(12) United States Patent
Kim et al.

(10) Patent No.: US 8,983,090 B2
(45) Date of Patent: Mar. 17, 2015

(54) MEMS MICROPHONE USING NOISE FILTER

(71) Applicant: Electronics and Telecommunications Research Institute, Daejeon (KR)

(72) Inventors: Yi-Gyeong Kim, Daejeon (KR); Min-Hyung Cho, Daejeon (KR); Tae Moon Roh, Daejeon (KR); Jong-Kee Kwon, Daejeon (KR); Woo Seok Yang, Daejeon (KR); Jongdae Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 59 days.

(21) Appl. No.: 13/762,300

(22) Filed: Feb. 7, 2013

(65) Prior Publication Data

US 2014/0079254 A1 Mar. 20, 2014

(30) Foreign Application Priority Data

Sep. 18, 2012 (KR) ..... 10-2012-0103347

(51) Int. Cl.
*H04R 15/00* (2006.01)
*H04R 3/00* (2006.01)
*H04R 19/00* (2006.01)

(52) U.S. Cl.
CPC ..... *H04R 3/00* (2013.01); *H04R 19/005* (2013.01); *H04R 2201/003* (2013.01); *H04R 2410/03* (2013.01)
USPC ..... 381/94.1; 381/111; 381/113

(58) Field of Classification Search
USPC ..... 381/111, 113, 94.1
See application file for complete search history.

(56) References Cited

U.S. PATENT DOCUMENTS

| | | | | |
|---|---|---|---|---|
| 7,098,739 | B2 | 8/2006 | Chow et al. | |
| 7,324,791 | B2 | 1/2008 | Nakatani et al. | |
| 7,489,191 | B2 | 2/2009 | Rao et al. | |
| 7,515,000 | B1 | 4/2009 | Jin et al. | |
| 8,666,095 | B2 * | 3/2014 | Hanzlik et al. | 381/111 |
| 8,699,726 | B2 * | 4/2014 | Steele et al. | 381/113 |
| 2007/0076904 | A1 | 4/2007 | Deruginsky et al. | |

* cited by examiner

*Primary Examiner* — Davetta W Goins
*Assistant Examiner* — Amir Etesam

(57) ABSTRACT

An MEMS microphone is provided which includes a reference voltage/current generator configured to generate a DC reference voltage and a reference current; a first noise filter configured to remove a noise of the DC reference voltage; a voltage booster configured to generate a sensor bias voltage using the DC reference voltage the noise of which is removed; a microphone sensor configured to receive the sensor bias voltage and to generate an output value based on a variation in a sound pressure; a bias circuit configured to receive the reference current to generate a bias voltage; and a signal amplification unit configured to receive the bias voltage and the output value of the microphone sensor to amplify the output value. The first noise filter comprises an impedance circuit; a capacitor circuit connected to a output node of the impedance circuit; and a switch connected to both ends of the impedance circuit.

10 Claims, 8 Drawing Sheets

MEMS MICROPHONE USING NOISE FILTER

CROSS-REFERENCE TO RELATED APPLICATIONS

A claim for priority under 35 U.S.C. §119 is made to Korean Patent Application No. 10-2012-0103347 filed Sep. 18, 2012, in the Korean Intellectual Property Office, the entire contents of which are hereby incorporated by reference.

BACKGROUND

The inventive concepts described herein relate to an MEMS microphone, and more particularly, relate to an MEMS microphone including a noise filter.

An MEMS microphone may include a microphone sensor and an MEMS microphone ASIC. A voltage booster in the ASIC may be supplied with a DC reference voltage, and may generate a sensor bias voltage by pumping the DC reference voltage using a charge pump. The charge pump may have a switched capacitor structure, in general. Thus, a noise included in the DC reference voltage may be also included in the sensor bias voltage. In this case, the microphone sensor may be affected directly by the noise included in the DC reference voltage.

A bias circuit included in the ASIC may be supplied with a reference current to generate a bias voltage of an amplifier. A differential amplifier can remove a bias noise. However, an amplifier of the MEMS microphone ASIC may not remove a noise due to impedance mismatching between a source follower and an input terminal. Thus, a noise included in the reference current may affect an output of the MEMS microphone.

A noise of a reference voltage/current generator may include a flicker noise and a thermal noise of a transistor. In general, the flicker noise may be reduced using a large-sized transistor, and the thermal noise may be reduced by increasing transconductance. However, since a size of a circuit implemented using the above-described methods is large, it is difficult to provide a small-sized MEMS microphone. Thus, there may be required a small-sized circuit capable of reducing a noise of a DC reference voltage and a noise of a reference current.

SUMMARY

One aspect of embodiments of the inventive concept is directed to provide an MEMS microphone which includes a reference voltage/current generator configured to generate a DC reference voltage and a reference current; a first noise filter configured to remove a noise of the DC reference voltage; a voltage booster configured to generate a sensor bias voltage using the DC reference voltage the noise of which is removed; a microphone sensor configured to receive the sensor bias voltage and to generate an output value based on a variation in a sound pressure; a bias circuit configured to receive the reference current to generate a bias voltage; and a signal amplification unit configured to receive the bias voltage and the output value of the microphone sensor to amplify the output value. The first noise filter comprises an impedance circuit; a capacitor circuit connected to an output node of the impedance circuit; and a switch connected to both ends of the impedance circuit.

In example embodiments, the impedance circuit comprises a first diode having a cathode connected to an input of the impedance circuit and an anode connected to an output of the impedance circuit; and a second diode having an anode connected to the input of the impedance circuit and a cathode connected to the output of the impedance circuit.

In example embodiments, the impedance circuit comprises a first MOS transistor having a source connected to an input of the impedance circuit, a drain connected to an output of the impedance circuit, and a gate connected to the output of the impedance circuit; and a second MOS transistor having a source connected to the output of the impedance circuit, a drain connected to the input of the impedance circuit, and a gate connected to the input of the impedance circuit.

In example embodiments, the first and second MOS transistors are either PMOS transistors or NMOS transistors.

In example embodiments, the impedance circuit comprises a first bipolar junction transistor having an emitter connected to an input of the impedance circuit, a collector connected to an output of the impedance circuit, and a gate connected to the output of the impedance circuit; and a second bipolar junction transistor having an emitter connected to the output of the impedance circuit, a collector connected to the input of the impedance circuit, and a gate connected to the input of the impedance circuit.

In example embodiments, the first and second bipolar junction transistors are either npn-type bipolar junction transistors or pnp-type bipolar junction transistors.

In example embodiments, the capacitor circuit includes one or more transistors.

In example embodiments, the capacitor circuit includes one or more ones of an MIM capacitor, a MOS capacitor, and a poly capacitor.

In example embodiments, at an initial operation, the switch is closed to charge the capacitor circuit.

In example embodiments, the MEMS microphone further comprises a second noise filter configured to remove a DC noise of the bias voltage and to provide the signal amplification unit with the bias voltage the DC noise of which is removed.

In example embodiments, the second noise filter is formed the same as the first noise filter.

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
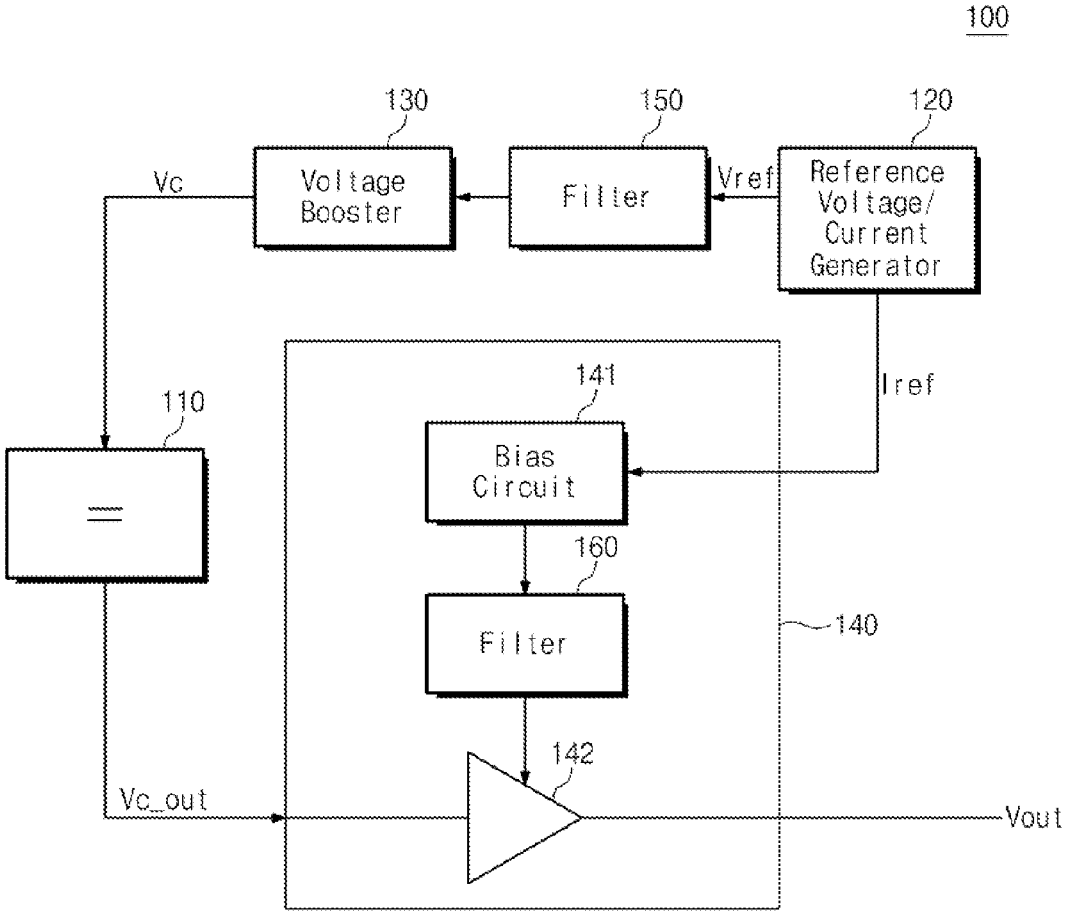
FIG. 1 is a block diagram schematically illustrating an MEMS microphone according to an embodiment of the inventive concept.

Embodiments will be described in detail with reference to the accompanying drawings. The inventive concept, however, may be embodied in various different forms, and should not be constructed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 is a block diagram schematically illustrating an MEMS microphone according to an embodiment of the inventive concept.

Referring to FIG. 1, an MEMS microphone 100 may include a microphone sensor 110, a reference voltage/current generator 120, a voltage booster 130, a signal amplification unit 140 and a noise filter 150. In example embodiments, the constituent elements 110, 120, 130, 140, and 150 may be built in a chip to be formed of an Application Specific Integrated Circuits (ASIC).

The microphone 110 may be a sensor which generates an electric signal based on a vibration of an input sound wave or ultrasonic wave. The microphone 110 may operate in a DC bias manner as a condenser type. The microphone 110 may include an electrode layer. A gap of the electrode layer may vary according to a sound pressure. The electrode layer may have a characteristic of a variable capacitor having a capacitance value varied according to the gap of the electrode layer. For example, in the case that a sound pressure varies at a state where a sensor bias voltage Vc is applied to the microphone 110, a capacitance value of the microphone 110 may vary. In this case, an output value Vc_out of the microphone 110 may vary. The output value Vc_out may be transferred to the signal amplification unit 140.

The reference voltage/current generator 120 may generate a DC reference voltage Vref and a reference current Iref necessary for the MEMS microphone 100. In example embodiments, the DC reference voltage Vref and the reference current Iref generated by the reference voltage/current generator 120 may be supplied to the noise filter 150. The reference current Iref generated by the reference voltage/current generator 120 may be supplied to a bias circuit 141.

The voltage booster 130 may receive the DC reference voltage Vref from the noise filter 150 to generate the sensor bias voltage Vc. A noise of the DC reference voltage Vref may be removed by the noise filter 150.

The signal amplification unit 140 may include the bias circuit 141, a noise filter 160, and an amplifier 142. The bias circuit 141 may receive the reference current Iref from the reference voltage/current generator 120 to generate an amplifier bias voltage to be supplied to the amplifier 132.

The noise filter 160 may remove a noise of the amplifier bias voltage provided from the bias circuit 141. The noise filter 160 will be more fully described with reference to FIG. 2.

The amplifier 132 may receive the output signal Vc_out from the microphone sensor 110 to amplify the output signal Vc_out. The amplified signal may be transfer to another device as an output signal Vout of the MEMS microphone 100.

The noise filter 150 may remove a noise of the DC reference voltage Vref provided from the reference voltage/current generator 120. The noise-free DC reference voltage Vref may be provided to the voltage booster 130.

Figure 2:
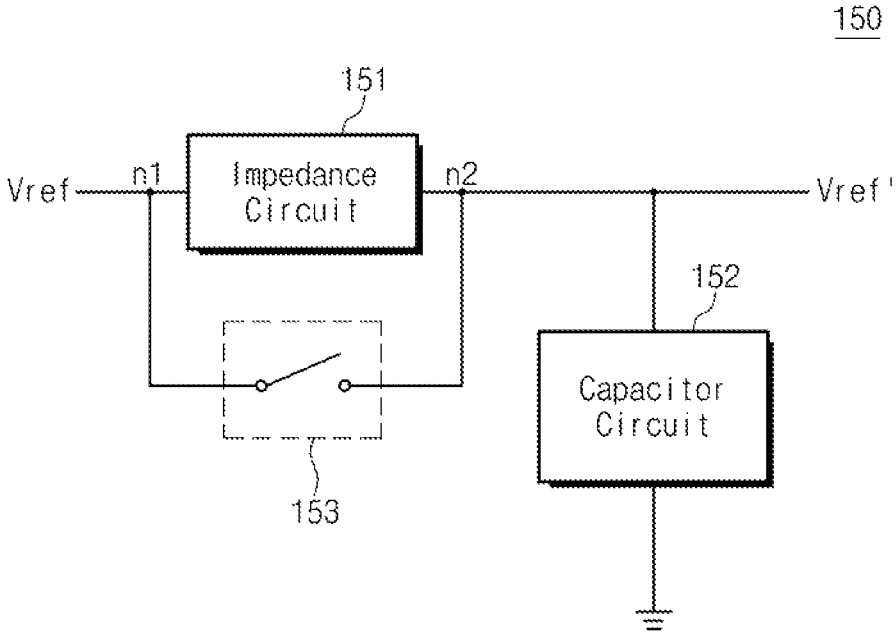
FIG. 2 is a block diagram schematically illustrating a noise filter according to an embodiment of the inventive concept.

FIG. 2 is a block diagram schematically illustrating a noise filter according to an embodiment of the inventive concept.

In example embodiments, a noise filter 160 of FIG. 1 may have the same configuration as that of a noise filter 150 of FIG. 2. Below, it is assumed that an input of the noise filter 150 is referred to as a first node n1 and an output of the noise filter 150 is referred to as a second node n2.

Referring to FIG. 2, the noise filter 150 may include an impedance circuit 151, a capacitor circuit 152, and a switch 153. The impedance circuit 151 may be a circuit having a large impedance value. For example, the impedance circuit 151 may be formed of a back-to-back diode, a back-to-back diode-connected MOSFET, a back-to-back diode-connected BJT, or the like. This will be more fully described with reference to FIGS. 3A to 3E.

One end of the capacitor circuit 152 may be connected to the second node n2. In example embodiments, the capacitor circuit 152 may be a circuit having at least one capacitor connected to the second node n2. For example, the capacitor circuit 152 may include a plurality of transistors. The capacitor circuit 152 can be formed of a MOS capacitor. Alternatively, the capacitor circuit 152 may be formed of capacitors (e.g., an MIM capacitor, an MOM capacitor, a poly capacitor, etc.) provided at an integrated circuit process.

The switch 153 may be used to connect the first and second nodes n1 and n2 such that voltages on the first and second nodes n1 and n2 are equalized in rapid time. The switch 153 may reduce a delay at an initial operation of the noise filter 160. For example, both ends of the switch 153 may be connected to the first and second nodes n1 and n2, respectively. At an initial operation of the noise filter 150, the switch 150 may be closed to charge the capacitor circuit 152. An impedance value of the impedance circuit 151 may be larger than that of the switch 153.

FIGS. 3A to 3E are diagrams illustrating an impedance circuit of FIG. 2 according to embodiments of the inventive concept. In example embodiments, an impedance circuit 151 may be formed of one of circuits illustrated in FIGS. 3A to 3E.

Figure 3A:
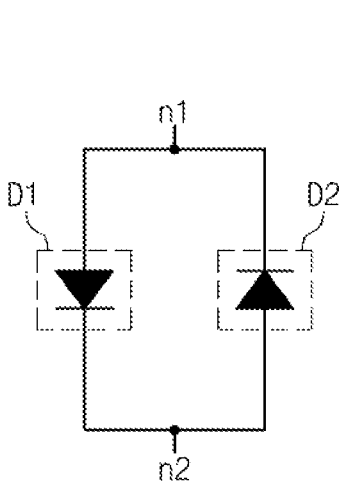
FIGS. 3A to 3E are diagrams illustrating an impedance circuit of FIG. 2 according to embodiments of the inventive concept.

Referring to FIG. 3A, the impedance circuit 151 may include first and second diodes D1 and D2. A cathode of the first diode D1 and an anode of the second diode D2 may be connected to a first node n1, and an anode of the first diode D1 and a cathode of the second diode D2 may be connected to a second node n2.

Figure 3B:
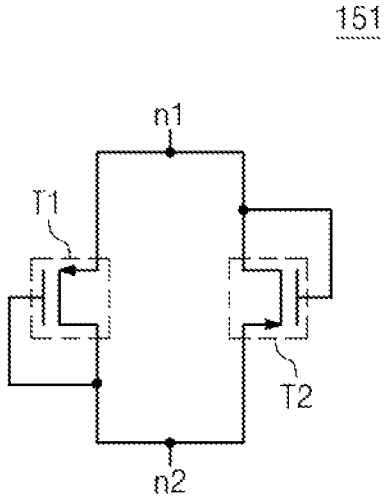
Figure 3C:
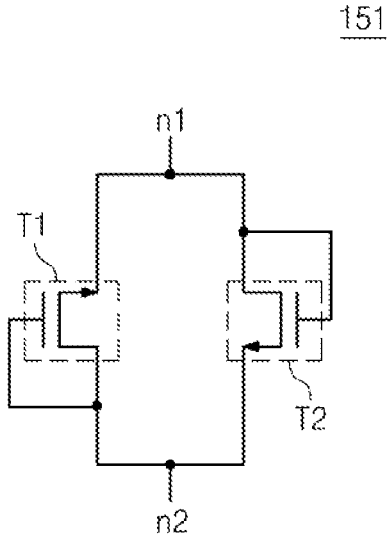

Referring to FIGS. 3B and 3C, the impedance circuit 151 may include first and second transistors T1 and T2. The first and second transistors T1 and T2 may be formed of p-type or n-type MOS transistors. A drain and gate of the second transistor T2 and source of the first transistor T1 may be connected to the first node n1. Gate and drain of the first transistor T1 and a source of the second transistor T2 may be connected to the second node n2.

Figure 3D:
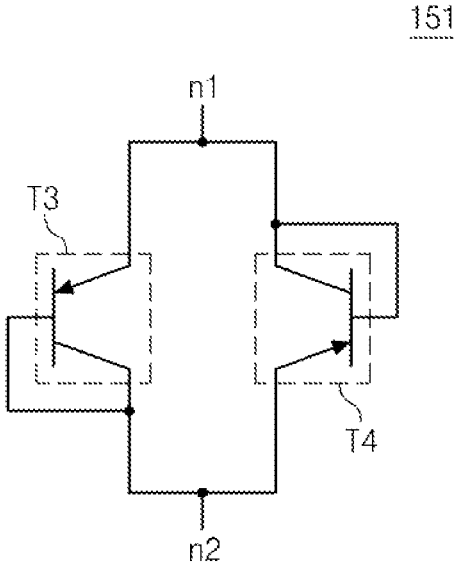
Figure 3E:
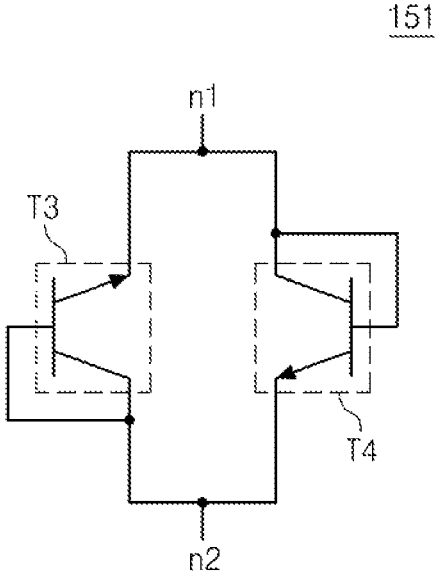

Referring to FIGS. 3D and 3E, the impedance circuit 151 may include third and fourth transistors T3 and T4. The third and fourth transistors T3 and T4 may be formed of npn-type or pnp-type bipolar junction transistors. An emitter of the third transistor T3 and collector and base of the fourth transistor T4 may be connected to the first node n1. Collector and base of the third transistor T3 and an emitter of the fourth transistor T4 may be connected to the second node n2.

The impedance circuit 151 formed using circuits described with reference to FIGS. 3A to 3E may have a large impedance value.

Figure 4A:
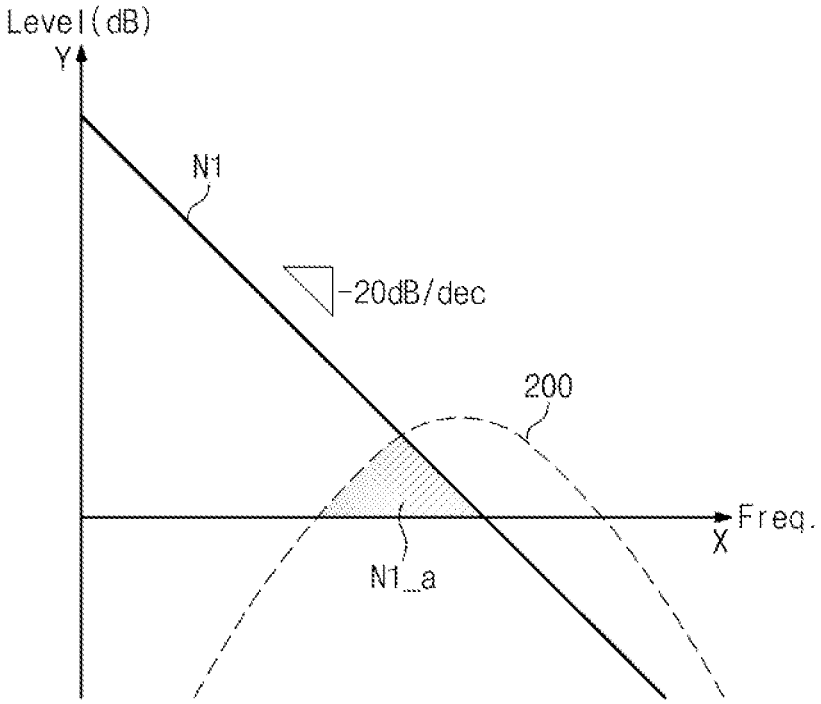
FIG. 4A is a graph illustrating a sound level on an MEMS microphone to which DC noise filters 150 and 160 are not applied.
Figure 4B:
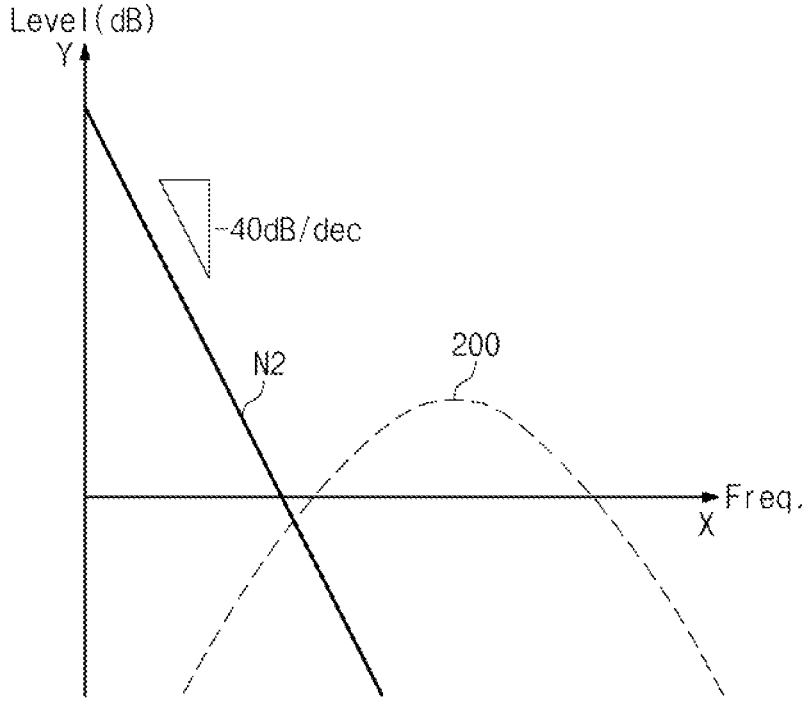
FIG. 4B is a graph illustrating a sound level on an MEMS microphone to which DC noise filters 150 and 160 are applied.

FIGS. 4A and 4B are graphs illustrating a noise reduction effect of an MEMS microphone 100 according to an embodiment of the inventive concept.

In FIGS. 4A and 4B, an X-axis may indicate a frequency, and a Y-axis may indicate a sound level. FIG. 4A is a graph illustrating a sound level on an MEMS microphone to which DC noise filters 150 and 160 are not applied. FIG. 4B is a graph illustrating a sound level on an MEMS microphone to which DC noise filters 150 and 160 are applied.

Referring to FIG. 4A, an output noise N1 of an MEMS microphone to which the noise filters 150 and 160 are not applied may have a noise characteristic of −20 dB/dec. The noise N1 may be a noise generated by a reference voltage/current generator 120. In comparison with an A-weighting level 200, the noise N1 of the MEMS microphone 100 may have a noise area N1_*a*. The larger the noise area N1_*a*, the larger distortion of a signal. The A-weighting level 200 may be one of characteristics of a weighting network used in a sound level meter, and may indicate a characteristic of a sound proximate to an audible frequency of a human.

Referring to FIG. 4B, an output noise N2 of an MEMS microphone to which the noise filters 150 and 160 are applied may have a noise characteristic of −40 dB/dec. As illustrated in FIG. 4B, compared with the A-weighting level 200, the output noise N2 of the MEMS microphone to which the noise filters 150 and 160 are applied may not have a noise area. Thus, it is possible to output an output signal Vout having a reduced noise.

With an embodiment of the inventive concept, it is possible to provide an MEMS microphone having an improved noise characteristic by reducing DC noises of a DC reference voltage and a reference current.

Figure 5:
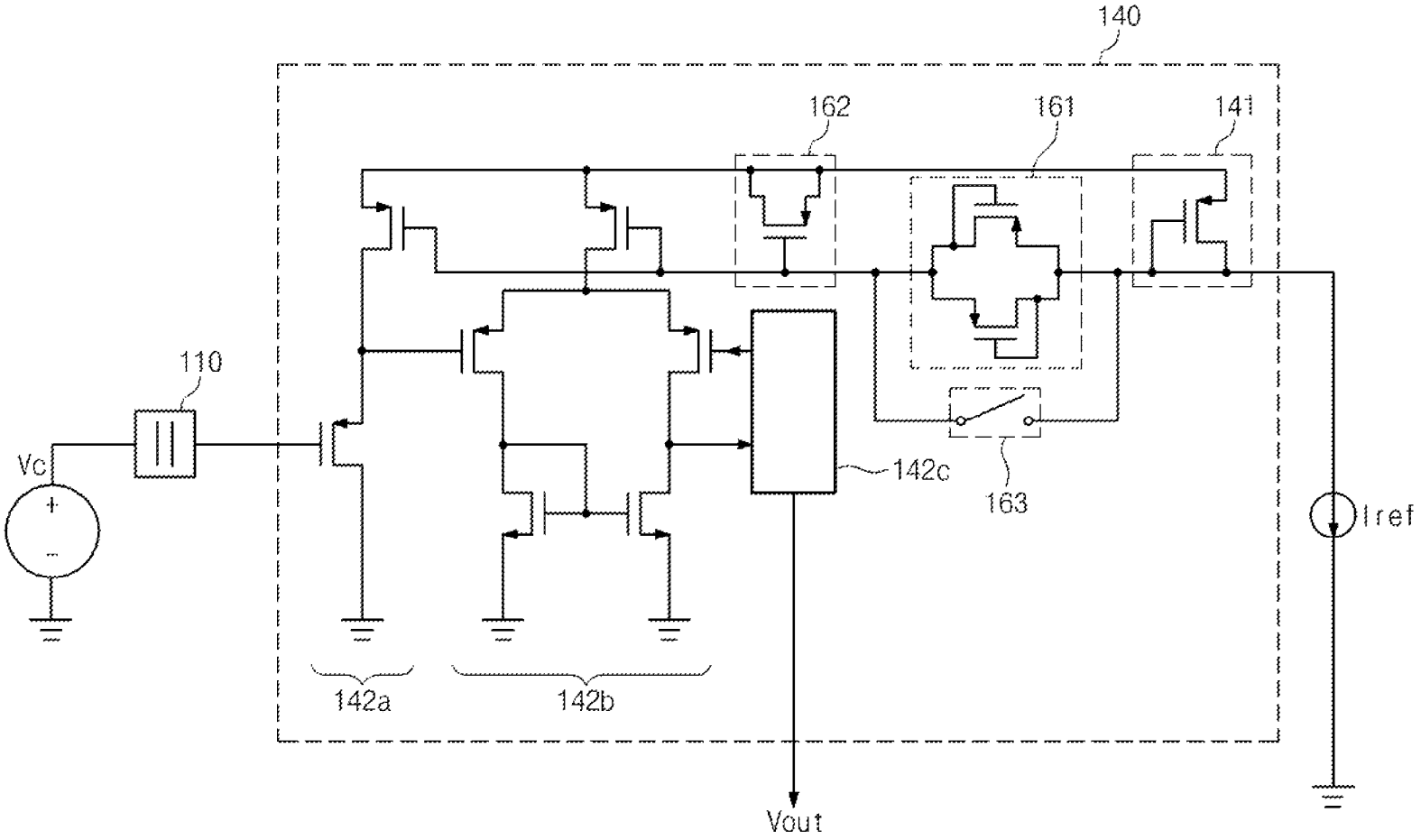
FIG. 5 is a circuit diagram illustrating a microphone sensor and a signal amplification unit including a noise filter according to an embodiment of the inventive concept.

FIG. 5 is a circuit diagram illustrating a microphone sensor and a signal amplification unit including a noise filter according to an embodiment of the inventive concept. An impedance circuit 161 of FIG. 5 may be formed of a circuit illustrated in FIG. 3B. However, the inventive concept is not limited thereto.

Referring to FIG. 5, a signal amplification unit 140 may include a bias circuit 141, a source follower 142*a*, an operational amplifier 142*b*, a feedback circuit 142*c*, an impedance circuit 161, a capacitor circuit 162, and a switch 163.

The bias circuit 141 may generate a bias voltage necessary for the source follower 142*a* and the operational amplifier 142*b* based on a reference current Iref. A noise of the bias voltage may be reduced by the impedance circuit 161 and the capacitor circuit 162, and the noise-free bias voltage may be applied to the source follower 142*a* and the operational amplifier 142*b*. The capacitor circuit 152 may include a metal oxide semiconductor capacitor using a transistor.

The microphone 110 may be supplied with a sensor bias voltage Vc, and may provide an output value Vc_out to the source follower 142*a* based on a variation in a sound pressure. The source follower 142*a*, the operational amplifier 142*b*, and the feedback circuit 142*c* may amplify the output value Vc_out based on the bias voltage to output an output signal Vout as an amplification result.

Since a noise component included in the reference current Iref is reduced by the impedance circuit 161 and the capacitor circuit 162, the output signal Vout may not be affected by a noise component included in the reference current Iref.

In example embodiments, at an initial operation of the signal amplification unit 140, the switch 163 may be closed such that the capacitor circuit 162 is charged with the bias voltage in rapid time.

Figure 6:
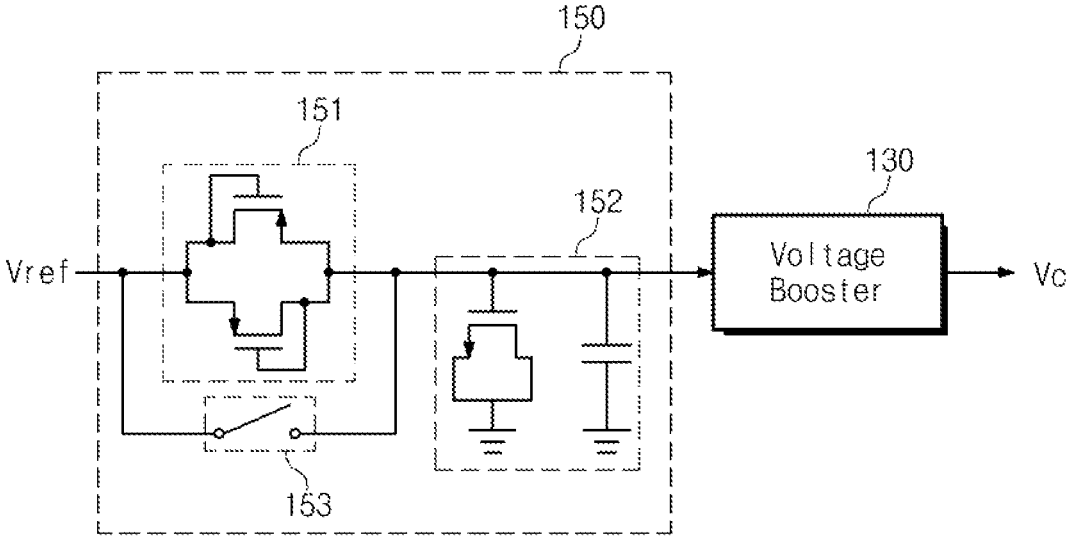
FIG. 6 is a block diagram schematically illustrating a voltage booster and a noise filter according to an embodiment of the inventive concept.

FIG. 6 is a block diagram schematically illustrating a voltage booster and a noise filter according to an embodiment of the inventive concept.

Referring to FIG. 6, an impedance circuit 151 may include PMOS transistors. The impedance circuit 151 may have an impedance value larger than that of a switch 153. The impedance circuit 151 may be connected to one end of the capacitor circuit 152. An output of the impedance circuit 151 may be connected to the voltage booster 130. The capacitor circuit 152 may be formed of a MOS capacitor using an NMOS transistor. The switch 153 may selectively connect both ends of the impedance circuit 151.

A noise of a DC reference voltage Vref provided from a reference voltage/current generator 120 may be reduced by the impedance circuit 151 and the capacitor circuit 152, and a noise-free DC reference voltage may be provided to the voltage booster 130. At an initial operation of the noise filter 150, the switch 153 may be closed such that the capacitor circuit 152 is charged with the DC reference voltage Vref in rapid time.

With the above description, it is possible to provide an MEMS microphone having an improved noise characteristic. Further, it is possible to implement a small-sized and low-power MEMS microphone using a semiconductor element.

Although not shown in figures, noise filters according to an embodiment of the inventive concept may reduce DC noises of a bias voltage of a signal amplification unit and a sensor bias voltage, and may be also connected to an output of the signal amplification unit or an output of a microphone sensor to remove a DC noise. Thus, it is possible to provide an MEMS microphone the noise characteristic of which is further improved.

While the inventive concept has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. An MEMS microphone, comprising:

a reference voltage/current generator configured to generate a DC reference voltage and a reference current;

a first noise filter configured to reduce a noise of the DC reference voltage;

a voltage booster configured to generate a sensor bias voltage using the DC reference voltage, the noise of which is reduced;

a microphone sensor configured to receive the sensor bias voltage and to generate an output value based on a variation in a sound pressure;

a bias circuit configured to receive the reference current to generate a bias voltage; and a signal amplification unit configured to receive the bias voltage and the output value of the microphone sensor to amplify the output value, wherein the first noise filter comprises:

an impedance circuit including a first MOS transistor and a second MOS transistor, the first MOS transistor having a source connected to an input of the impedance circuit, a drain connected to an output of the impedance circuit, and a gate connected to the output of the impedance circuit, the second MOS transistor having a source connected to the output of the impedance circuit, a drain connected to the input of the impedance circuit, and a gate connected to the input of the impedance circuit;

a capacitor circuit connected to an output node of the impedance circuit; and a switch connected to both ends of the impedance circuit.

2. The MEMS microphone of claim 1, wherein the first and second MOS transistors are either PMOS transistors or NMOS transistors.

3. The MEMS microphone of claim 1, wherein the capacitor circuit includes one or more transistors.

4. The MEMS microphone of claim 1, wherein the capacitor circuit includes any of an MIM capacitor, a MOS capacitor, a poly capacitor, and a combination thereof.

5. The MEMS microphone of claim 1, wherein at an initial operation, the switch is closed to charge the capacitor circuit.

6. The MEMS microphone of claim 1, further comprising:

a second noise filter configured to reduce a DC noise of the bias voltage and to provide the signal amplification unit with the bias voltage the DC, the noise of which is reduced.

7. The MEMS microphone of claim 6, wherein the second noise filter is has the same configuration as the first noise filter.

8. An MEMS microphone, comprising:

a reference voltage/current generator configured to generate a DC reference voltage and a reference current;

a first noise filter configured to reduce a noise of the DC reference voltage;

a voltage booster configured to generate a sensor bias voltage using the DC reference voltage, the noise of which is reduced;

a microphone sensor configured to receive the sensor bias voltage and to generate an output value based on a variation in a sound pressure;

a bias circuit configured to receive the reference current to generate a bias voltage; and a signal amplification unit configured to receive the bias voltage and the output value of the microphone sensor to amplify the output value, wherein the first noise filter comprises:

an impedance circuit including a first diode and a second diode, the first diode having a cathode connected to an input of the impedance circuit and an anode connected to an output of the impedance circuit, the second diode having an anode connected to the input of the impedance circuit and a cathode connected to the output of the impedance circuit;

a capacitor circuit connected to an output node of the impedance circuit; and a switch connected to both ends of the impedance circuit.

9. An MEMS microphone, comprising:

a reference voltage/current generator configured to generate a DC reference voltage and a reference current;

a first noise filter configured to reduce a noise of the DC reference voltage;

a voltage booster configured to generate a sensor bias voltage using the DC reference voltage, the noise of which is reduced;

a microphone sensor configured to receive the sensor bias voltage and to generate an output value based on a variation in a sound pressure;

a bias circuit configured to receive the reference current to generate a bias voltage; and a signal amplification unit configured to receive the bias voltage and the output value of the microphone sensor to amplify the output value, wherein the first noise filter comprises:

an impedance circuit including a first bipolar junction transistor and a second bipolar junction transistor, the first bipolar junction transistor having an emitter connected to an input of the impedance circuit, a collector connected to an output of the impedance circuit, and a gate connected to the output of the impedance circuit, the second bipolar junction transistor having an emitter connected to the output of the impedance circuit, a collector connected to the input of the impedance circuit, and a gate connected to the input of the impedance circuit;

a capacitor circuit connected to an output node of the impedance circuit; and a switch connected to both ends of the impedance circuit.

10. The MEMS microphone of claim 9, wherein the first and second bipolar junction transistors are either npn-type bipolar junction transistors or pnp-type bipolar junction transistors.

* * * * *